US011898756B2

(12) United States Patent
Liu

(10) Patent No.: US 11,898,756 B2
(45) Date of Patent: Feb. 13, 2024

(54) MULTI-NOZZLE FUEL INJECTION METHOD FOR GAS TURBINE

(71) Applicant: Qingdao Zhennuo Laser Technology Co., Ltd., Shandong (CN)

(72) Inventor: Xunchen Liu, Shanghai (CN)

(73) Assignee: Qingdao Zhennuo Laser Technology Co., Ltd., Qingdao (CN)

( * ) Notice: Subject to any disclaimer, the term of this patent is extended or adjusted under 35 U.S.C. 154(b) by 0 days.

(21) Appl. No.: 18/097,696

(22) Filed: Jan. 17, 2023

(65) Prior Publication Data

US 2023/0228425 A1 Jul. 20, 2023

(30) Foreign Application Priority Data

Jan. 18, 2022 (CN) ..... 202210055660.4

(51) Int. Cl.

| | |
|---|---|
| ***F23R 3/34*** | (2006.01) |
| ***F23R 3/44*** | (2006.01) |
| *F23R 3/04* | (2006.01) |
| *F23R 3/26* | (2006.01) |
| *F23R 3/28* | (2006.01) |
| *F23R 3/16* | (2006.01) |

(52) U.S. Cl.

CPC ..... *F23R 3/346* (2013.01); *F23R 3/44* (2013.01); *F23R 3/045* (2013.01); *F23R 3/16* (2013.01); *F23R 3/26* (2013.01); *F23R 3/286* (2013.01)

(58) Field of Classification Search

CPC .... F23R 3/14; F23R 3/286; F23R 3/34; F23R 3/346

See application file for complete search history.

(56) References Cited

U.S. PATENT DOCUMENTS

| | | | | |
|---|---|---|---|---|
| 3,872,664 | A * | 3/1975 | Lohmann | F23R 3/346 431/9 |
| 4,058,977 | A * | 11/1977 | Markowski | F23R 3/12 431/352 |
| 4,173,118 | A * | 11/1979 | Kawaguchi | F23C 3/00 431/352 |
| 11,067,281 | B1 * | 7/2021 | Garcia | F23R 3/005 |
| 11,566,790 | B1 * | 1/2023 | Hughes | F23R 3/286 |
| 11,578,871 | B1 * | 2/2023 | Joshi | F23R 3/20 |
| 2007/0089419 | A1 * | 4/2007 | Matsumoto | F23R 3/06 60/737 |

(Continued)

FOREIGN PATENT DOCUMENTS

| | | | | |
|---|---|---|---|---|
| CN | 111237806 | A * | 6/2020 | F23R 3/14 |

*Primary Examiner* — William H Rodriguez

(74) *Attorney, Agent, or Firm* — Kirk A. Wilson; Joseph T. Guy; Patent Filing Specialist Inc.

(57) ABSTRACT

Disclosed is a fuel mixed injection method for a gas turbine. The method includes the following steps: arranging a secondary fuel injection nozzle and a secondary air injection nozzle on a secondary combustion section, wherein the secondary fuel injection nozzles is closer to a main combustion section than the secondary air injection nozzle; and injecting secondary fuel and secondary primary air in sequence through the secondary fuel injection nozzle and the secondary air injection nozzle, respectively, thus enabling the secondary fuel to spontaneously combust in a mainstream high-temperature flue gas atmosphere to form a transverse jet flame and increase the flame lift-off height.

7 Claims, 7 Drawing Sheets

(56) References Cited

U.S. PATENT DOCUMENTS

2010/0095649 A1* 4/2010 Blouch ..... F23R 3/36 60/39.463
2011/0296839 A1* 12/2011 Van Nieuwenhuizen ..... F23R 3/346 60/737
2013/0074946 A1* 3/2013 Ramier ..... F23R 3/286 137/154
2013/0239575 A1* 9/2013 Chen ..... F23R 3/286 60/747
2014/0196465 A1* 7/2014 Laster ..... F23R 3/346 60/737
2014/0238034 A1* 8/2014 Slobodyanskiy ..... F23R 3/002 60/752
2014/0260262 A1* 9/2014 Davis, Jr. ..... F23R 3/20 60/734
2014/0260269 A1* 9/2014 Davis, Jr. ..... F23R 3/28 60/737
2015/0285501 A1* 10/2015 DiCintio ..... F23R 3/346 60/740
2015/0285504 A1* 10/2015 Melton ..... B23K 26/702 60/737
2017/0219212 A1* 8/2017 Laster ..... F02C 3/30
2017/0321609 A1* 11/2017 Ogata ..... F23R 3/36
2018/0187607 A1* 7/2018 Hughes ..... F02C 7/222
2018/0209651 A1* 7/2018 Cai ..... F23R 3/346
2019/0063754 A1* 2/2019 Dudebout ..... F23R 3/06
2019/0072279 A1* 3/2019 Natarajan ..... F23R 3/002
2019/0178498 A1* 6/2019 Wilson ..... F23R 3/346
2021/0025323 A1* 1/2021 Nakao ..... F23R 3/06
2021/0199299 A1* 7/2021 Berry ..... F23R 3/36
2021/0199300 A1* 7/2021 Berry ..... B01F 25/3141
2021/0404660 A1* 12/2021 Godfrey ..... F23R 3/286
2022/0389832 A1* 12/2022 Scipio ..... F23D 14/64
2022/0389833 A1* 12/2022 Scipio ..... B08B 3/08
2022/0389863 A1* 12/2022 Scipio ..... B08B 9/0325
2022/0412563 A1* 12/2022 Giridharan ..... F02C 3/30

* cited by examiner

MULTI-NOZZLE FUEL INJECTION METHOD FOR GAS TURBINE

CROSS-REFERENCE TO RELATED APPLICATION

This patent application claims the benefit and priority of Chinese Patent Application No. 202210055660.4, filed with the China National Intellectual Property Administration on Jan. 18, 2022, the disclosure of which is incorporated by reference herein in its entirety as part of the present application.

TECHNICAL FIELD

The present disclosure relates to the field of gas turbines, and in particular relates to a multi-nozzle fuel injection method for a gas turbine.

BACKGROUND

Gas turbine is a rotary impeller engine consisting of a compressor, a combustion chamber and a turbine, which is widely used in many industrial fields such as ship power, power generation and oil and gas transportation due to its advantages of high energy conversion efficiency and low pollutant emissions. In recent years, advanced ground gas turbines are developing towards higher efficiency and lower pollutant emissions. The improvement of combustion technology makes the emissions of unburned hydrocarbons (UHC) and carbon monoxide (CO) meet the requirements of environmental protection. However, with the increasing operating pressure and temperature of the combustion chamber, nitrogen oxide (NOx) has become the most difficult pollutant to control. Generally, the traditional low-pollution combustion chamber controls the NOx generation by adopting a fully lean premixed combustion mode, including an end cover, a guide bushing, a housing, nozzles and other parts, as shown in the structure of FIG. 1. However, the lean premixed combustion technology may produce poor combustion stability, thermoacoustic oscillations, and small tempering and load regulation range in the near flameout limit conditions.

To solve the contradiction between gas turbine efficiency increase and pollutant emission control, axial fuel staged combustion technology can achieve the target of low emission at higher turbine inlet temperature. As shown in FIG. 2, part of fuel and air are diverted to the secondary combustion zone through the axial staged combustion technology, and premixed fuel air mixture is injected by a single nozzle on the wall surface of the combustion chamber, which ignite in a high-temperature and low-oxygen environment to further increase the outlet temperature of the combustion chamber.

However, the existing axial staged combustor has the following defects that: the equivalence ratio and jet trajectory cannot be controlled independently, and the problem of coking may occur after the premixed fuel and air are injected from a single nozzle, and the premixed combustion has a certain dangerousness.

SUMMARY

An objective of the present disclosure is to provide a multi-nozzle fuel injection method for a gas turbine to solve the problems above. To this end, the present disclosure employs the following technical solutions.

A multi-nozzle fuel injection method for a gas turbine is provided. The gas turbine includes an axial staged combustor including a main combustion section and a secondary combustion section, and the main combustion section is configured to produce mainstream high-temperature flue gas. The method includes the following steps:

arranging a secondary fuel injection nozzle and a secondary air injection nozzle on the secondary combustion section, wherein the secondary fuel injection nozzles is closer to the main combustion section than the secondary air injection nozzle; and injecting secondary fuel and secondary primary air in sequence through the secondary fuel injection nozzle and the secondary air injection nozzle, respectively, thus enabling the secondary fuel to spontaneously combust in a mainstream high-temperature flue gas atmosphere to form a transverse jet flame and increase the flame lift-off height.

In a preferred embodiment, the shapes of the secondary fuel injection nozzle and the secondary air injection nozzle are round.

In a preferred embodiment, a distance between the secondary fuel injection nozzle and the secondary air injection nozzle is set to be greater than 2d; and d is the larger of the diameter of the secondary fuel injection nozzle and the diameter of the secondary air injection nozzle.

In a preferred embodiment, the secondary fuel injection nozzle and the secondary air injection nozzle have the same diameter.

In a preferred embodiment, the secondary fuel injection nozzle and the secondary air injection nozzle each have a diameter of 1 mm to 5 mm, and the distance between the secondary fuel injection nozzle and the secondary air injection nozzle is 10 mm to 20 mm.

In a preferred embodiment, the secondary fuel injection nozzle and the secondary air injection nozzle each are cast from rare earth heat-resistant steel.

In a preferred embodiment, the secondary fuel includes hydrogen, ammonia, syngas, natural gas, and biosynthetic fuels.

In a preferred embodiment, the secondary fuel injection nozzle and the secondary air injection nozzle are respectively connected to a secondary fuel supply pipeline and a secondary air supply pipeline, and the secondary fuel supply pipeline and the secondary air supply pipeline are respectively provided with corresponding flow control valves.

In a preferred embodiment, the method further includes the following step:

adjusting air flux according to a combustion state.

In a preferred embodiment, the method further includes the following step: providing a development section, which is located between the main combustion section and the secondary combustion section and is configured to rectify the mainstream high-temperature flue gas.

By providing the secondary fuel injection nozzle and the secondary air injection nozzle on the secondary combustion section, the fuel and the air enter a combustion chamber in a separated state. On the one hand, the problems of dangerousness and coking caused by premixed combustion reaction can be avoided; on the other hand, the flame lift-off height can be increased to make the flame away from the wall surface, thus avoiding the problem of producing thermal nitrogen oxides in a premixed combustion high-temperature area and avoiding the generation of wall surface high temperature. The control of the fuel injection mode is more flexible.

DETAILED DESCRIPTION OF THE EMBODIMENTS

The preferred embodiments of the present disclosure are described in detail below with reference to the accompanying drawings for a clearer understanding of the objects, features and advantages of the present disclosure. It should be understood that the embodiments shown in the embodiments are not intended to limit the scope of the present disclosure, but only to illustrate the essential spirit of the technical solutions of the present disclosure.

Figure 1:
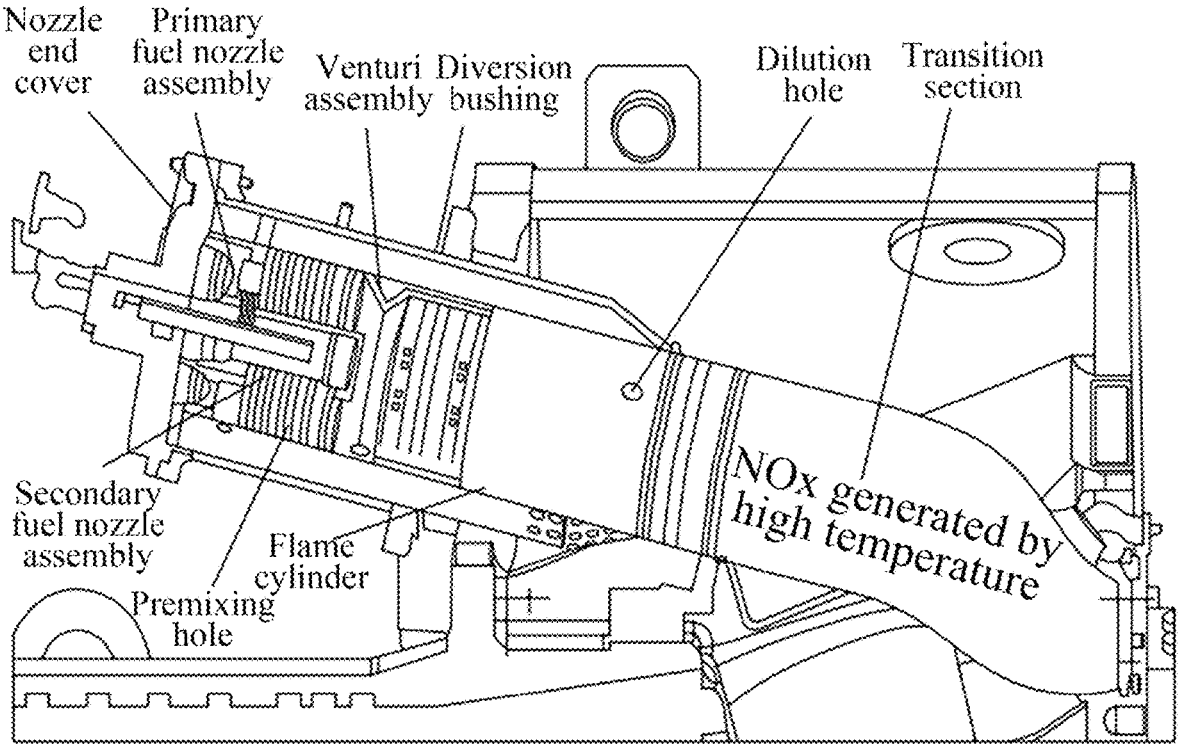
(Prior Art) FIG. 1
FIG. 1 is a structure diagram of an axial staged combustor of an existing gas turbine.
Figure 2:
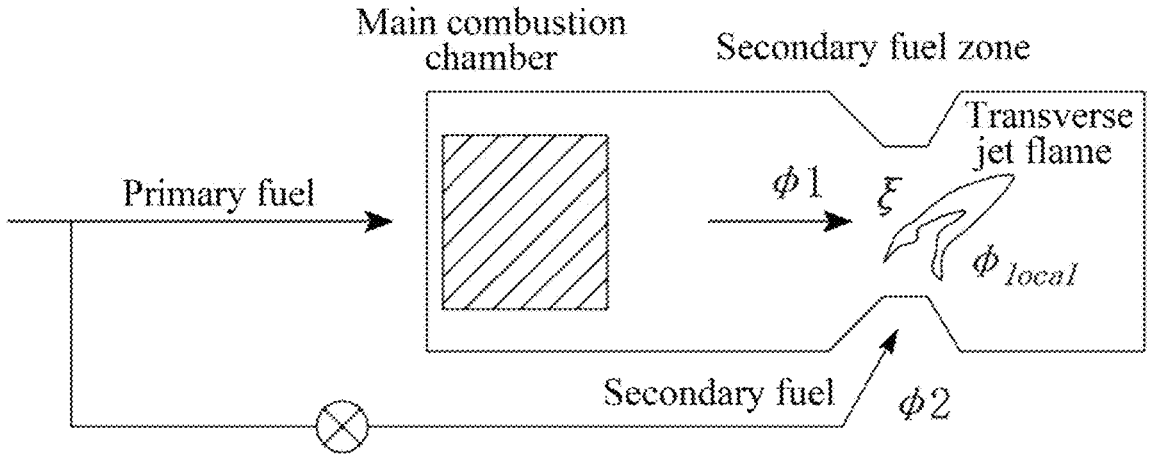
(Prior Art) FIG. 2
FIG. 2 is a schematic diagram of axial staged combustion technology.
Figure 3:
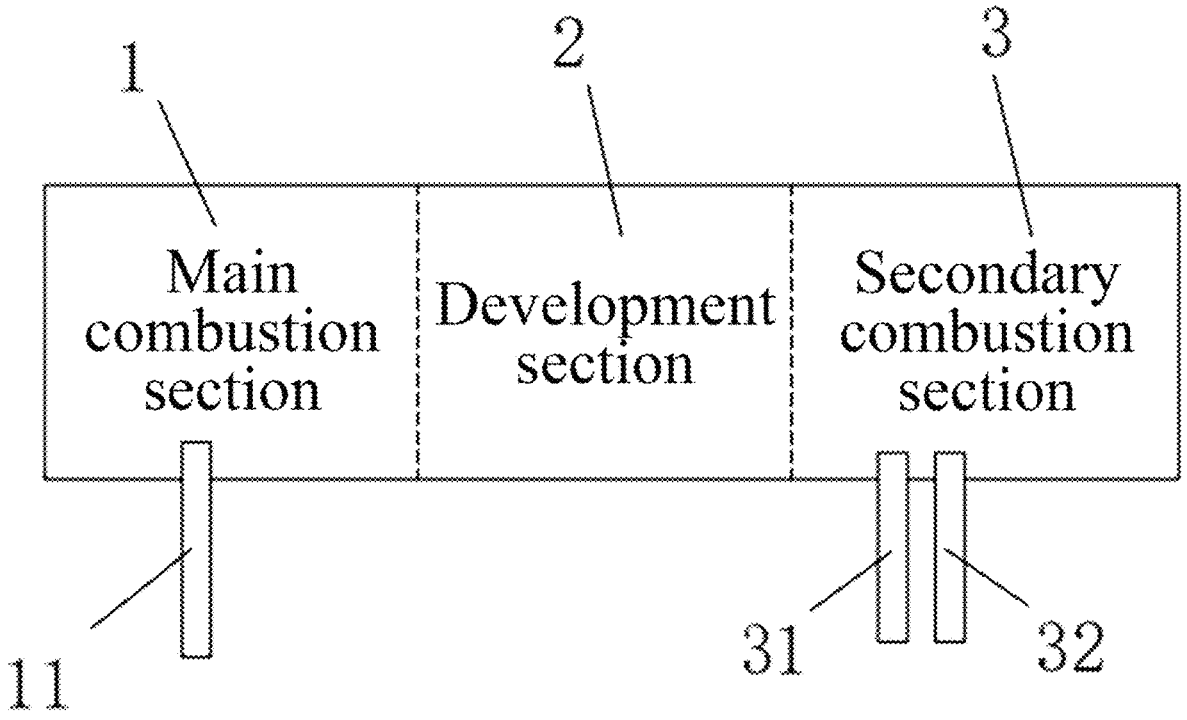
FIG. 3 is a structure diagram of an axial staged combustor in accordance with the present disclosure.

As shown in FIG. 3, a multi-nozzle fuel injection method for a gas turbine is provided. The gas turbine includes an axial staged combustor. The axial staged combustor may include a main combustion section 1, a development section 2, and a secondary combustion section 3. The main combustion section is configured to generate mainstream high-temperature flue gas. That is, the air and fuel, after being premixed in proportion, are injected into the main combustion section for combustion through a nozzle 11, thus generating mainstream high-temperature flue gas. The development section 2 is located between the main combustion section and the secondary combustion section and is configured to rectify the mainstream high-temperature flue gas, thus allowing the rectified mainstream high-temperature flue gas to enter the secondary combustion section 3 evenly. It should be understood that the development section 2 may also be omitted. The secondary combustion section 3 is provided with a secondary fuel injection nozzle 31 and a secondary air injection nozzle 32, and the secondary fuel injection nozzle 31 is closer to the main combustion section 1 (or the development section 2) than the secondary air injection nozzle 32, so that the secondary fuel can be injected into the secondary combustion section before the secondary air. The fuel and air can be better mixed under the action of the mainstream high-temperature flue gas, which in turn spontaneously combust in the mainstream high temperature flue gas atmosphere to form a lateral jet flame and increase the flame lift-off height. Two nozzles are respectively used for fuel injection and air injection to make the fuel and the air enter a combustion chamber in a separated state. On the one hand, the problems of dangerousness and coking caused by premixed combustion reaction can be avoided; on the other hand, the flame lift-off height can be increased to make the flame away from the wall surface, thus avoiding the wall surface high temperature and the generation of high-concentration pollutants. Meanwhile, the air volume can be freely adjusted according to a combustion state due to the fact that the air is injected after the fuel is injected.

The shapes of the secondary fuel injection nozzle 31 and the secondary air injection nozzle 32 are round. A distance between the secondary fuel injection nozzle 31 and the secondary air injection nozzle 32 may be flexibly adjusted. Preferably, the distance between the secondary fuel injection nozzle 31 and the secondary air injection nozzle 32 is set to be greater than 2d, where d is the larger of the diameter of the secondary fuel injection nozzle 31 and the diameter of the secondary air injection nozzle 32. The secondary fuel injection nozzle 31 and the secondary air injection nozzle 32 have the same diameter under normal conditions. It should be understood that the diameters of the secondary fuel injection nozzle and the secondary air injection nozzle may be different to adapt to different working conditions.

In a preferred embodiment, the secondary fuel injection nozzle 31 and the secondary air injection nozzle 32 each have a diameter of 1 mm to 5 mm, and the distance between the secondary fuel injection nozzle 31 and the secondary air injection nozzle 32 is 10 mm to 20 mm.

In this embodiment, the secondary fuel injection nozzle 31 and the secondary air injection nozzle 32 are perpendicular, i.e., an incident angle is perpendicular to the mainstream high-temperature flue gas. It should be understood that the secondary fuel injection nozzle 31 and the secondary air injection nozzle 32 may be arranged obliquely (for example, less than 10 degrees from a vertical direction).

The secondary fuel injection nozzle and the secondary air injection nozzle each are cast from rare earth heat-resistant steel so as to improve the service life. The secondary fuel injection nozzle 31 and the secondary air injection nozzle 32 may be manufactured independently, or may be manufactured integrally. The secondary fuel injection nozzle 31 and the secondary air injection nozzle 32 are respectively connected to a secondary fuel supply pipeline and a secondary air supply pipeline (not shown in figure), and the secondary fuel supply pipeline and the secondary air supply pipeline are respectively provided with corresponding flow control valves (not shown in figure), thus facilitating to control the respective flow rate and improving the combustion efficiency.

As the secondary fuel and the secondary air are separately injected, the secondary fuel may be flammable and explosive high-performance fuel such as hydrogen, ammonia, syngas, natural gas and bio-synthetic fuel.

Therefore, a multi-nozzle fuel injection method for a gas turbine may include the following steps:

arranging a secondary fuel injection nozzle 31 and a secondary air injection nozzle 32 on a secondary combustion section 3, wherein the secondary fuel injection nozzle 31 is closer to a main combustion section 11 than the secondary air injection nozzle 32; and injecting secondary fuel and secondary primary air in sequence through the secondary fuel injection nozzle 31 and the secondary air injection nozzle 32, respectively, thus enabling the secondary fuel to spontaneously combust in the mainstream high-temperature flue gas atmosphere to form a transverse jet flame and increase the flame lift-off height.

The fuel and the air are injected through the secondary fuel injection nozzle 31 and the secondary air injection nozzle 32 to make the fuel and the air enter a combustion chamber in a separated state. On the one hand, the problems of dangerousness and coking caused by premixed combustion reaction can be avoided; on the other hand, the flame lift-off height may be increased to make the flame away from the wall surface, thus avoiding the wall surface high temperature and the generation of high-concentration pollutants.

In addition, the method further include the following step: providing a development section 2, wherein the development section 2 is located between the main combustion section 1 and the secondary combustion section 2 and is configured to rectify the mainstream high-temperature flue gas, thus allowing the rectified mainstream high-temperature flue gas to enter the secondary combustion section 3 evenly.

Preferably, the method may further include the following step: adjusting air flux according to a combustion state during injection, thus improving the combustion efficiency.

Figure 4:
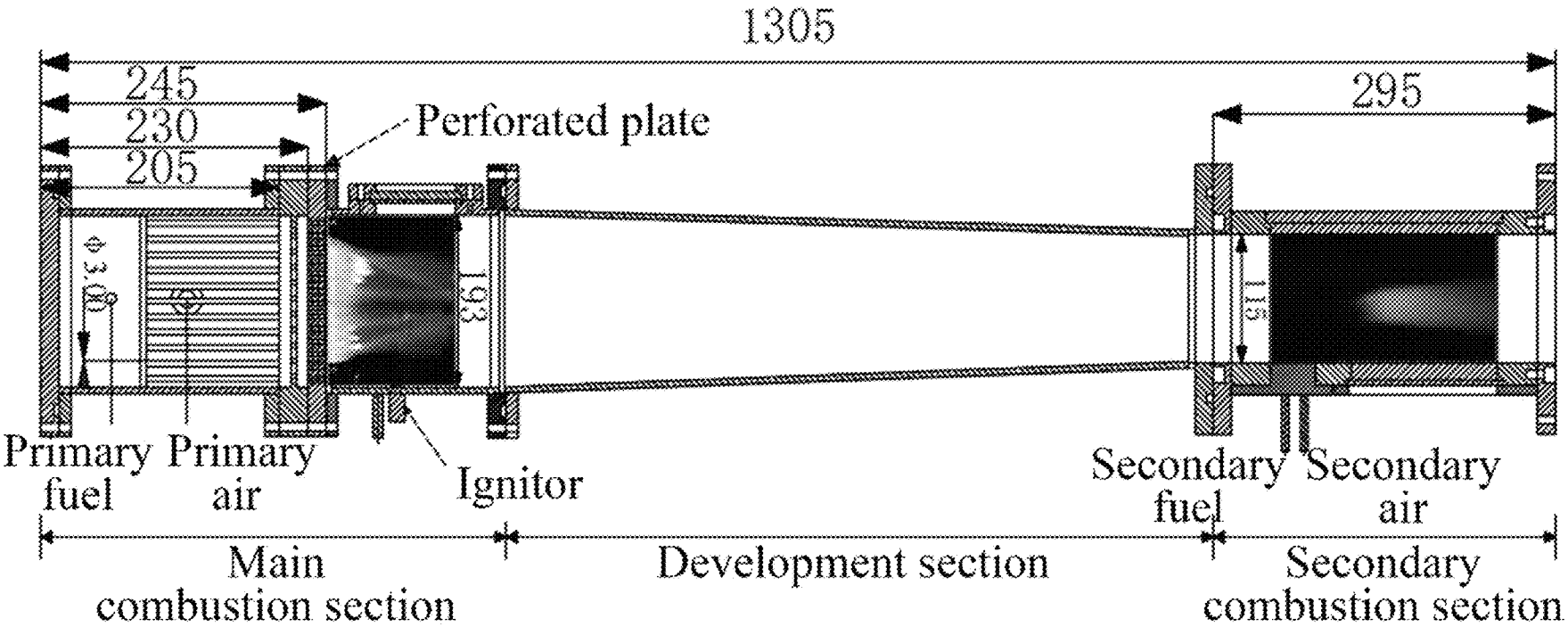
FIG. 4 is a schematic diagram of an axial staged combustor for an experiment in accordance with the present disclosure.

To research the influence of different nozzle designs on dynamic combustion characteristics of the transverse jet flame, an axial staged combustor for experiment is constructed. As shown in FIG. 4, the emission characteristics and combustion dynamic characteristics of single nozzle and twin-nozzle structures, with 2 mm and 3 mm diameter are measured. Specifically, FIG. 4 is a structure diagram of an axial staged combustor in accordance with the present disclosure. The combustor is divided into three parts: a main combustion section, a development section, and a secondary combustion section. The main combustion section is provided with a blunt body plate with a thickness of 25 mm and a perforated plate with a thickness of 15 mm to even the plane mainstream flame and generate high-temperature flue gas. The secondary combustion section has a cross-section size of 40 mm×115 mm and a length of 295 mm. The secondary fuel spontaneously combusts in a mainstream high-temperature flue gas atmosphere to form a transverse jet flame, and the secondary combustion section is surrounded by quartz glass for optical diagnosis. The outlet is open to make the whole system in a combustion state at normal pressure.

A flow field and a scalar mixing field of single and double nozzles in a cold working condition are measured by cold acetone plane laser-induced fluorescence (PLIF) and particle image velocimetry (PIV) experiments. The fluorescence emitted by CH* in the flame is photographed by a high-speed camera (Phototron SA-Z) equipped with an image intensifier (LambertHiCATT), a short-focus lens (Nikkon 50 mm f/1.4G) and a narrow-band-pass filter (Semrock 433/25 nm), thus obtaining the continuous change process of spatial distribution of CH free radicals in the flame. At a frame rate of 40 kHz, the pixel resolution of the camera is 512×1024, and the spatial resolution of CH* self-luminous image is 0.1 mm. The imaging of the image intensifier is subjected to white field correction. Mie scattering of PIV particles occurs under the irradiation of 532 nm laser, and scattering signals are recorded by the high-speed camera. A PIV image is processed by a cross-correlation algorithm in Davis8.4 software to obtain velocity field distribution at the corresponding time.

Figure 5:
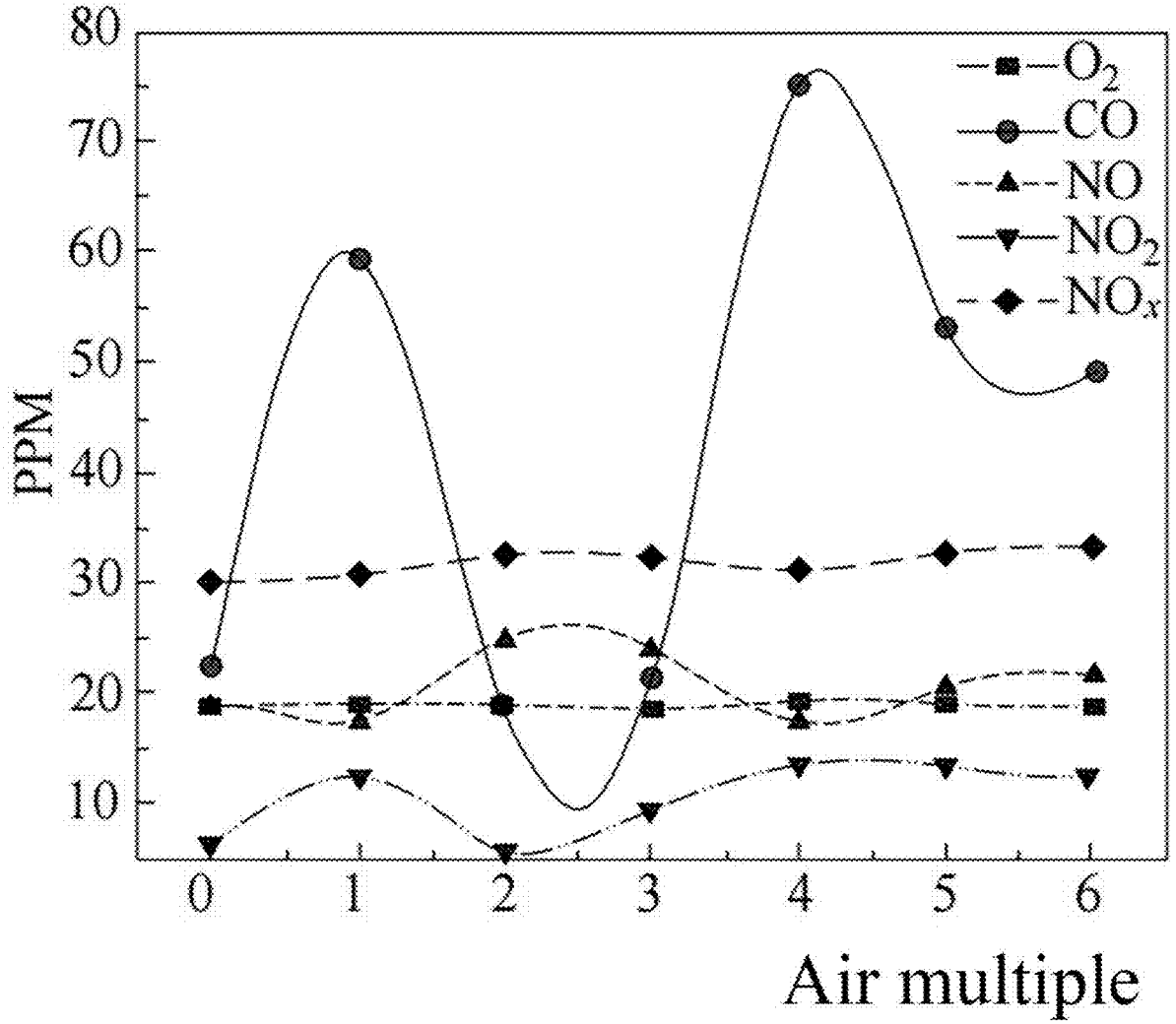
FIG. 5 is a curve graph showing characteristics of pollutant emission in a case that different multiples of air are injected from secondary dual nozzle.

FIG. 5 illustrates curves of outlet oxygen content and pollutant emission under different secondary air injection volumes. It can be known from FIG. 5 that: (i) with the increase of the secondary air injection volume, the CO emission shows a double-crest characteristic, and due to the synergistic oxidation of CO to $NO_2$, the generation of $NO_2$ also shows the same trend, while NO, as a synergistic oxidation reactant, shows an opposite double-valley trend. (ii) Under the combined action of a local equivalence ratio and flame lift-off, with the increase of the secondary air injection volume, an oxygen-enriched atmosphere is formed, and cold air has a cooling effect at the same time; and the total amount of NOx is almost unchanged under the combined action of the oxygen-enriched atmosphere and the cold air. (iii) The factors such as CO generation and $NO_2$ ratio are comprehensively considered.

Figure 6:
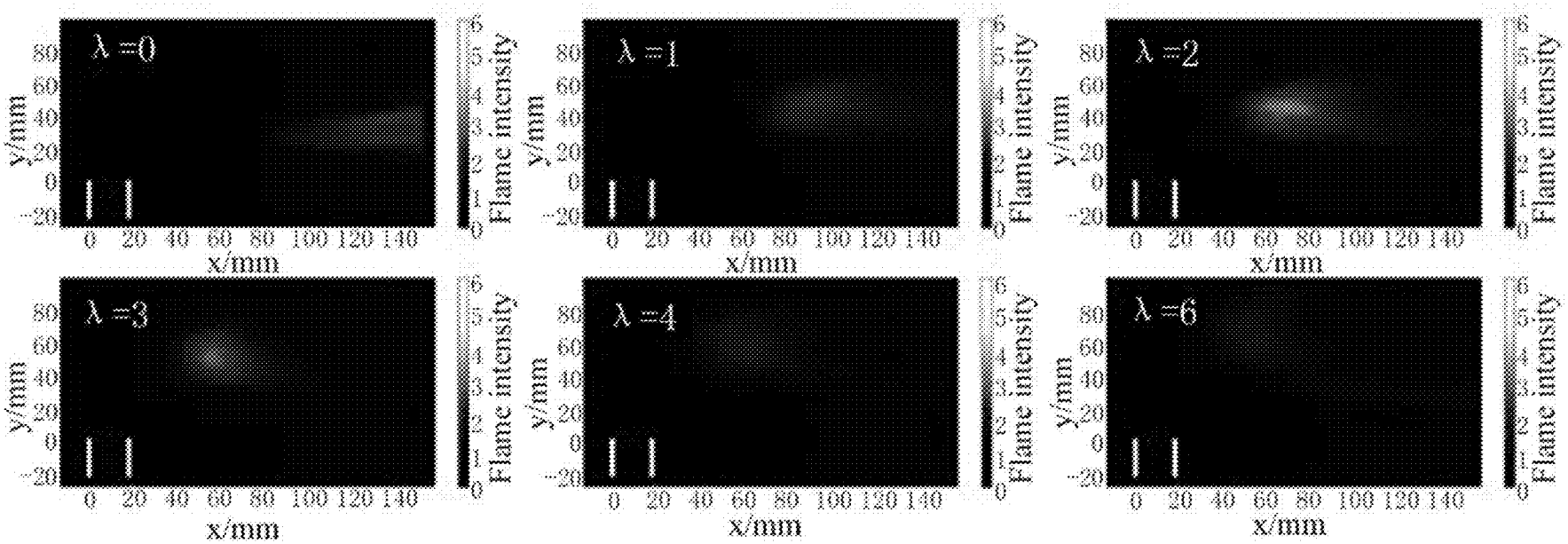
FIG. 6 is a photo illustrating flame characteristics in a case that different multiples of air is injected from secondary dual nozzle.

Different air injection volumes of the secondary nozzles have great influence on flame morphology, and a ratio of the secondary air injection to the fuel is defined as λ FIG. 6 is a CH* self-luminous time-averaged image of the flame at different secondary air injection volumes of a 3 mm nozzle when φ=0.65 and FS=0.11, and the nozzle is marked in white in the figure. It can be known from FIG. 6 that: (i) when λ=0, the flame root is sharp, with obvious stratification characteristics. (ii) When λ increases from 0 to 3, the impact chopping of the air on the jet increases mixing, the local oxygen content increases, the lift-off height decreases, the premixing characteristics at the flame root are obvious, and the local heat release rate increases. (iii) When λ increases from 3 to 6, the temperature in front of the flame is decreased by cold air, and the lift-off distance no longer decreases, and therefore, the secondary air injection volume needs to be determined in a reasonable range.

The equivalence ratio and the nozzle have a significant influence on the jet flame morphology. In axial staged combustion, the equivalence ratio increases, the incoming temperature rises, and the reaction intensity increases. However, the decrease of oxygen concentration and the increase of water, $CO_2$ and other products in flue gas lead to the decrease of the secondary reaction intensity. This antagonistic action may lead to a nonlinear change trend between the secondary jet flame morphology and the total equivalence ratio. In addition, the nozzle also affects the flame morphology by influencing the flow field structure.

Figure 7:
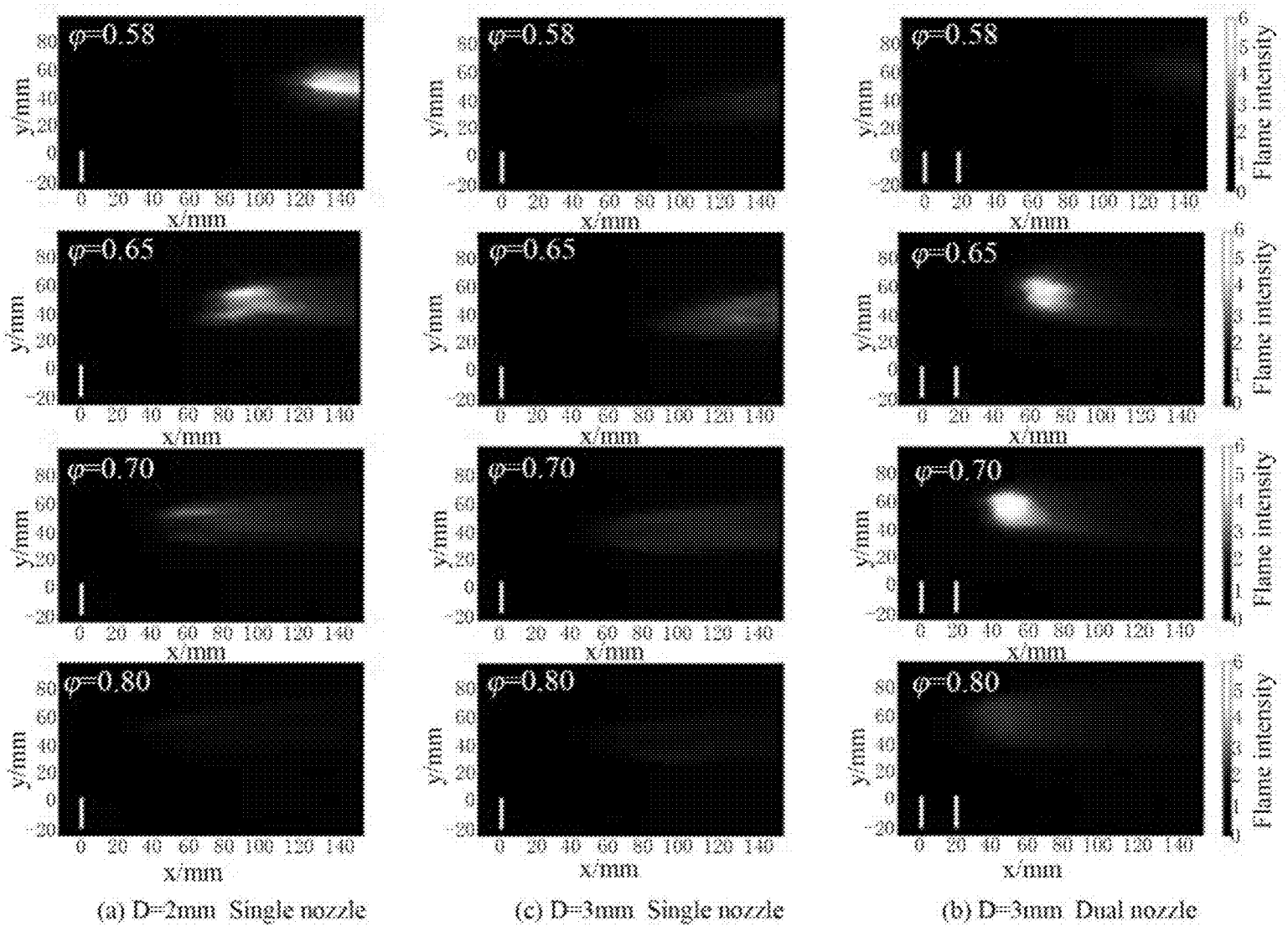
FIG. 7 is a flame morphology diagram of a total equivalence ratio, different nozzles and secondary jet mixed with the air when a load ratio FS=0.15.

FIG. 7 illustrates a flame morphology characterized by CH* self-luminous average images under different equivalence ratios, different nozzles and air conditions. Longitudinal comparison of (a), (b) and (c) shows that: (i) the equivalence ratio decreases, the ignition delay increases, the flame lift-off distance increases, the flame root temperature rises, and the heat release rate enhances, reflecting the difference between pure fuel jet and premixed jet. (ii) The flame brightness decreases under the working condition, reflecting that the decrease in mainstream temperature due to low equivalence ratio has become the dominant factor for controlling the secondary reaction by replacing the increase in oxygen content. (iii) Generally speaking, with the increase of the equivalence ratio, the preheating effect of the flue gas on the jet fuel is enhanced, which is close to MILD combustion; and the flame brightness is weak and the edge tends to be dispersed, showing the characteristics of stratified combustion.

Horizontal comparison of (a) and (b) shows that: When the equivalence ratio and jet flow rate remain unchanged, the nozzle diameter increases, the jet velocity decreases, the flame lift-off height and the length increase, the brightness concentration area on the flame surface decreases, and the diffusion combustion characteristics are obvious.

Horizontal comparison of (b) and (c) shows that: When the total equivalence ratio and the jet outlet velocity remain unchanged, the oxygen concentration increases after the air (k=2) is injected downstream of the nozzle, meanwhile, the air jet has an impact on the fuel jet to enhance the mixing; the ignition delay is shortened, the flame length is reduced, the brightness is increased, the heat release zone is concentrated on the flame root, and stratified combustion characteristics disappear. (ii) When the air is injected from the secondary nozzle, the local heat release rate is reduced, and the lift-off distance is further increased, and such an abnormal phenomenon also proves that the oxygen concentration is no longer the dominant factor affecting the flame behavior when the equivalent ratio is 0.58.

In conclusion, the premixing degree may be increased by adopting the secondary dual-nozzle design. However, when the equivalence ratio is low and the incoming temperature plays a leading role, the downstream injection of air may delay the ignition and increase the flame length.

Figure 8:
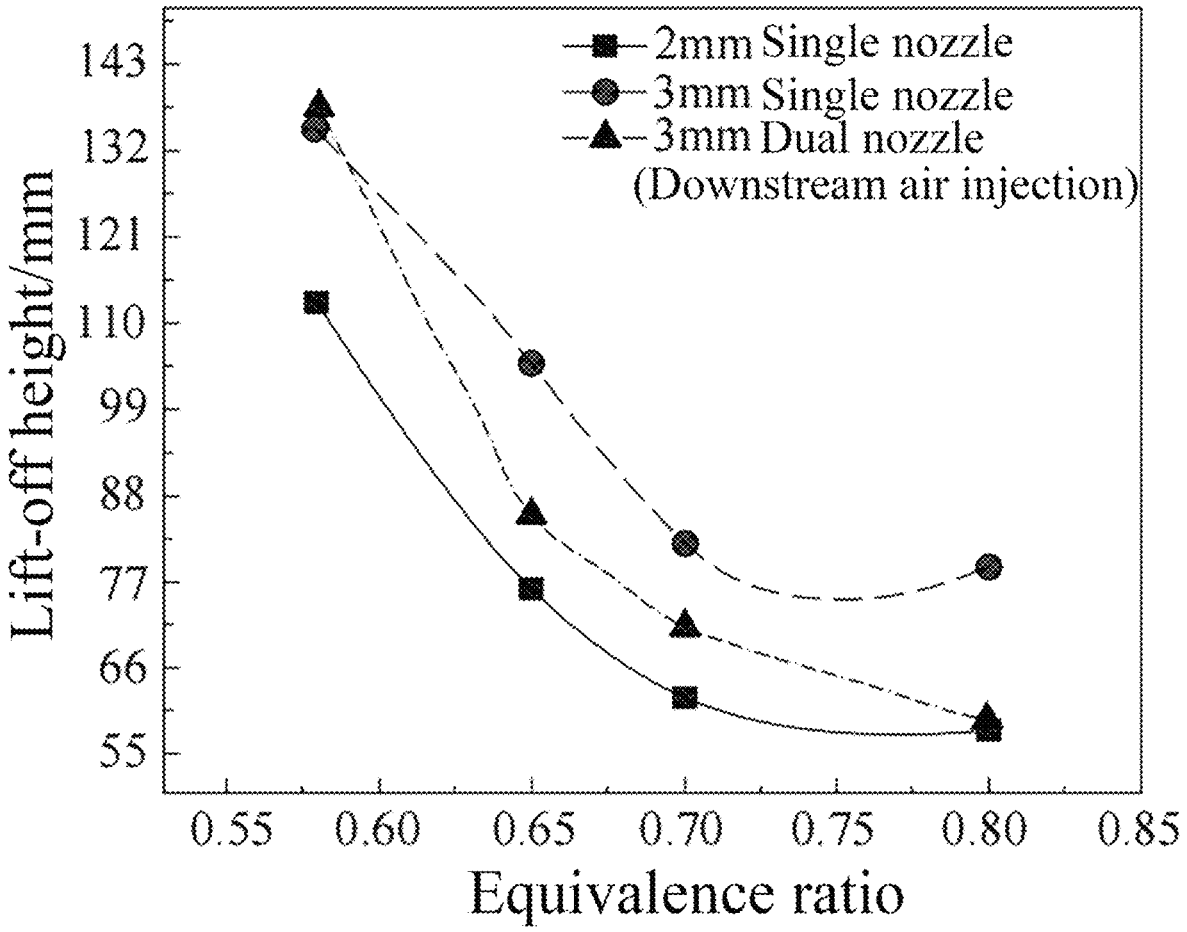
FIG. 8 is a curve graph illustrating the relationship between the lift-off height and the total equivalent ratio under different nozzles.

FIG. 8 shows a relationship between the lift-off height and the total equivalence ratio under different nozzles. It can be known from FIG. 8 that when the air is injected downstream of the nozzle, the lift-off height of the flame increases to make the flame away from the wall surface, and with the gradual increase of the equivalence ratio, the lift-off height shows a decrease trend.

While preferred embodiments of the present disclosure have been described in detail above, it should be understood that various alterations or modifications may be made to the present disclosure by those skilled in the art after reading the above teachings of the present disclosure. Such equivalents are likewise intended to fall within the scope defined by the appended claims.

What is claimed is:

1. A multi-nozzle fuel injection method for a gas turbine, wherein the gas turbine comprises an axial staged combustor comprising a main combustion section and a secondary combustion section, and the main combustion section is configured to produce mainstream high-temperature flue gas; wherein the method comprises the following steps:

arranging a secondary fuel injection nozzle and a secondary air injection nozzle on the secondary combustion section, wherein the secondary fuel injection nozzle is closer to the main combustion section than the secondary air injection nozzle; and injecting secondary fuel and secondary primary air in sequence through the secondary fuel injection nozzle and the secondary air injection nozzle, respectively, the secondary fuel being injected into the secondary combustion section before the secondary air thus enabling the secondary fuel to spontaneously combust in a mainstream high-temperature flue gas atmosphere to form a transverse jet flame and increase the flame lift-off height;

wherein the secondary fuel injection nozzle and the secondary air injection nozzle are perpendicular to a mainstream high-temperature flue gas; a distance between the secondary fuel injection nozzle and the secondary air injection nozzle is set to be greater than 2d, and d is the larger of the diameter of the secondary fuel injection nozzle and the diameter of the secondary air injection nozzle.

2. The method according to claim 1, wherein the shapes of the secondary fuel injection nozzle and the secondary air injection nozzle are both round.

3. The method according to claim 1, wherein the secondary fuel injection nozzle and the secondary air injection nozzle have the same diameter.

4. The method according to claim 3, wherein the secondary fuel injection nozzle and the secondary air injection nozzle each have a diameter of 1 mm to 5 mm, and the distance between the secondary fuel injection nozzle and the secondary air injection nozzle is 10 mm to 20 mm.

5. The method according to claim 1, wherein the secondary fuel injection nozzle and the secondary air injection nozzle each are cast from rare earth heat-resistant steel.

6. The method according to claim 1, wherein the secondary fuel injection nozzle and the secondary air injection nozzle are respectively connected to a secondary fuel supply pipeline and a secondary air supply pipeline, and the secondary fuel supply pipeline and the secondary air supply pipeline are respectively provided with corresponding flow control valves.

7. The method according to claim 6, wherein the method further comprises the following step: adjusting air flux according to a combustion state.

* * * * *